United States Patent [19]

Van Soest et al.

[11] 4,315,581

[45] Feb. 16, 1982

[54] HOLDER FOR ELECTROGRAPHIC DEVELOPING POWDER

[75] Inventors: Hendrikus J. J. Van Soest; Peter M. W. Mennen, both of Helden, Netherlands

[73] Assignee: Océ-Nederland B.V., Venlo, Netherlands

[21] Appl. No.: 134,190

[22] Filed: Mar. 26, 1980

[30] Foreign Application Priority Data

Mar. 27, 1979 [NL] Netherlands ..... 7902361

[51] Int. Cl.[3] ..... B67B 7/24

[52] U.S. Cl. ..... 222/83; 222/DIG. 1

[58] Field of Search ..... 222/DIG. 1, 83, 83.5, 222/82, 88; 206/603; 141/89, 364

[56] References Cited

U.S. PATENT DOCUMENTS

| | | | |
|---|---|---|---|
| 3,539,077 | 11/1970 | Drexler | 222/82 |
| 3,651,838 | 3/1972 | Albert | 141/284 |
| 3,898,956 | 8/1975 | Andrako | 222/DIG. 1 |
| 4,062,385 | 12/1977 | Katusha et al. | 141/89 |
| 4,237,943 | 12/1980 | Ermel | 141/284 |

*Primary Examiner*—Stanley H. Tollberg
*Attorney, Agent, or Firm*—Albert C. Johnston

[57] ABSTRACT

A holder for electrographic developing powder comprises an oblong outlet opening for the powder and has the opening covered by a membrane and by a slide valve which is movable along channels bordering the opening and is provided near one of its ends with a cutting device that cuts the membrane as the slide valve is moved from a first position closing off the opening to a second position not covering the opening. The holder comprises a flexible end portion that can be contracted by being pinched in a direction substantially parallel to the plane of the slide valve, and from which projections extend laterally for engagement with notches in guides that support the holder over a powder reservoir. The cutting device is moved toward the flexible end portion as the slide valve is moved from the first to the second position. The slide valve has a greater cross dimension near its end carrying the cutting device than near its other end, whereby the flexible end portion of the holder cannot be contracted by being pinched when the slide valve does not cover the opening.

16 Claims, 10 Drawing Figures

HOLDER FOR ELECTROGRAPHIC DEVELOPING POWDER

This invention relates to a holder for electrographic developing powder, of a kind which is provided with an oblong outlet opening for the powder, with a closing membrane fixed powdertight on the holder over the opening, with a slide valve over the opening and the closing membrane, which slide valve is movable relative to the holder longitudinally of the opening between a first position closing off the outlet opening and a second position uncovering the outlet opening, with an element for removing the membrane from the opening, and with flanges for installing the holder slidingly in guides above a developing powder reservoir of an electrographic apparatus.

A powder holder of that kind is disclosed in German "Offenlegungsschrift" No. 2 610 661. In that disclosure the holder is slid from the slide valve into guides extending above the developing powder reservoir in order to enable the powder to stream out of the opening, and the membrane comprises a bent lip. After the holder has been slid forth above the reservoir, the membrane is removed from the opening by pulling on the free end of the lip. The slide valve, however, is left on an element which projects outside the powder reservoir and joins the guides, and after the powder has streamed out the holder is slid back from above the powder reservoir to a position over the slide valve.

The purpose of that known construction is to keep an operator from coming in contact with the interior of the holder, which generally contains residues of highly polluting developing powder, also called toner powder. The powder reservoir and consequently the outlet opening and the slide valve generally have a length corresponding to the width of an electrographic image-forming medium, which width amounts to some tens of centimeters. It results that the mentioned projecting element has the same length, thus requiring the electrographic apparatus to be made wider at the location of the developing powder reservoir than is necessitated by the dimensions of the developing powder reservoir. This is a disadvantage when a compact apparatus is required.

The principal object of the present invention is to provide a powder holder of the kind above mentioned with which an operator does not come in contact with parts that have been exposed to the developing powder, and which requires no parts extending beyond the dimensions of the developing powder reservoir for filling the reservoir from the holder.

In such a powder holder, according to the invention, guide means are provided along the outlet opening, along which guide means the slide valve is movable, and the element for removing the membrane from the opening comprises a cutting device mounted near that end of the slide valve which moves along the opening when the slide valve is slid from the first into the second position.

In that way it is achieved that when the slide valve is being slid from the first into the second position the membrane is cut open along an increasing part of the outlet opening, and the powder then streams by gravity out of the holder through the opening made in the membrane. The opening in the membrane becomes larger in proportion as the slide valve arrives closer to the second position. Since the cutting device is located near that end of the slide valve which uncovers the outlet opening, it results that the part of the slide valve that extends from the holder does not come in contact with the developing powder. Moreover, upon simply sliding the slide valve back into the first position, no part that may be covered with developing powder is any longer accessible.

According to a preferred embodiment of the invention, the cutting device cuts the membrane between the first and the second position by a cutting line that is not closed in itself. In this simple way, it is achieved that the opened membrane remains connected with the holder so that it cannot fall into the developing powder reservoir.

According to a further feature of the invention, in a holder having the cutting device situated near parts of its side wall in the second position of the slide valve, at least one side wall part is provided with at least one projection which extends transverse to the sliding direction of the holder; the side wall parts form a flexible part of the holder that can be pinched in a direction substantially parallel to the plane of the slide valve; and the slide valve possesses a greater cross dimension near the end supporting the cutting device than near the other end. In this way, it is achieved that in the second position of the slide valve the holder cannot be pinched, and the projections of a holder placed in an electrographic apparatus are kept jammed behind elements mounted firmly in the apparatus. It results that the holder cannot be removed from such an apparatus before the slide valve has been slid back into the first position and, consequently, no parts covered with developing powder are accessible when removing the holder from such an apparatus.

A further feature of a preferred embodiment of the invention consists in that the guide means along which the slide valve is movable are channels which are formed in and longitudinally of the flanges that support the holder, and the projections project from the flanges at the location of the side wall parts. Thus, the differences in the cross dimensions of the slide valve have the greatest effect on the pinching of the flexible side wall parts of the holder at the location of the projections.

The invention will be further understood from the accompanying drawings and the following description of an illustrative embodiment. In the drawings.

Figure 1:
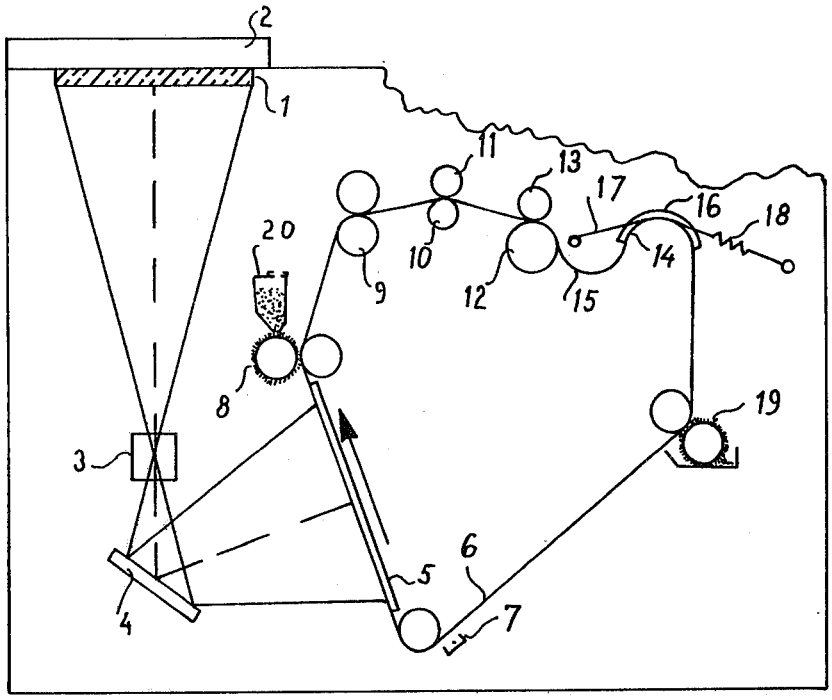
FIG. 1 is a schematic cross section of an electrophotographic copying apparatus equipped with a holder for developing powder.

An electrophotographic copying apparatus in which a powder holder of the invention can be employed is represented schematically in FIG. 1. In this copying apparatus an original to be copied can be laid down on an exposure plate 1 and pressed down by a covering pressure cushion 2. Then the downward side of the original can be exposed to light from flash lamps (not shown), thus forming an image of the original which is projected by a lens 3 and a mirror 4 onto an endless photoconductive belt 6. This belt is driven by a roller 9 which may be provided with a coating having a high coefficient of friction.

Before being exposed, the belt 6 is conveyed past a corona device 7 by which a uniformly distributed electrostatic charge is applied on the photoconductive layer of the belt. The belt then is conveyed in flat condition over a suction box 5, where the belt receives the image provided by the flash exposure of the original and forms a corresponding electrostatic charge image by discharge of the exposed parts of the photoconductive layer. This charge image is now developed into a powder image in known manner by contact with a magnetic brush 8.

The belt with the resulting powder image is passed over the drive roller 9 and subsequently arrives in a transfer station 10, 11 where the powder image can be transferred to a roller 11 in known manner under the influence of pressure between the rollers 10 and 11 and by proper selection of the surface of roller 11. The roller 11 preferably has a surface layer of soft elastic material, for instance of silicone rubber. The powder image can then be transferred from roller 11, for instance to copy paper supplied over that roller. A suitable manner of transferring the image, though having no further direct relation to the present invention, is disclosed, for instance, in U.S. Pat. No. 4,068,937.

The belt 6 can be kept properly aligned and tensioned by a system as disclosed in U.S. Pat. No. 3,846,021. For this purpose, for instance, the belt is conveyed over a roller 19 provided with a counter-pressure roller 13, and passes to a stationary curved surface 14 having a raised side edge 16 for guiding the belt in lateral direction, and a cloth 17 which is fixed in place and kept taut by a spring 18 presses the belt against the surface 14. This is effected in such manner that a freely-hanging loop 15 is formed in the belt between the roller 12 and the surface 14. The cloth 17 may consist of felt strips arranged over the whole width of the belt, but preferably narrow felt strips 17 are provided to bear against margins of the belt near the side edges only of the surface 14.

Any residue of the powder image being left on belt 6 is removed with the aid of a brush 19. After passing the brush 19 the belt 6 again moves past the corona device 7, in order to be again provided with a uniform electrostatic charge for the formation of a next copy.

Figure 2:
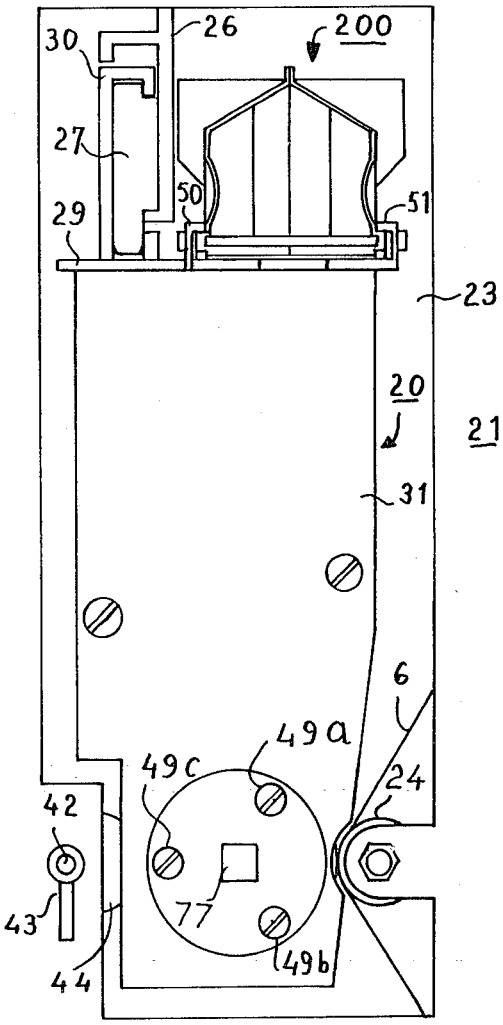
FIG. 2 is a side view of the developing section of the copying apparatus.
Figure 3:
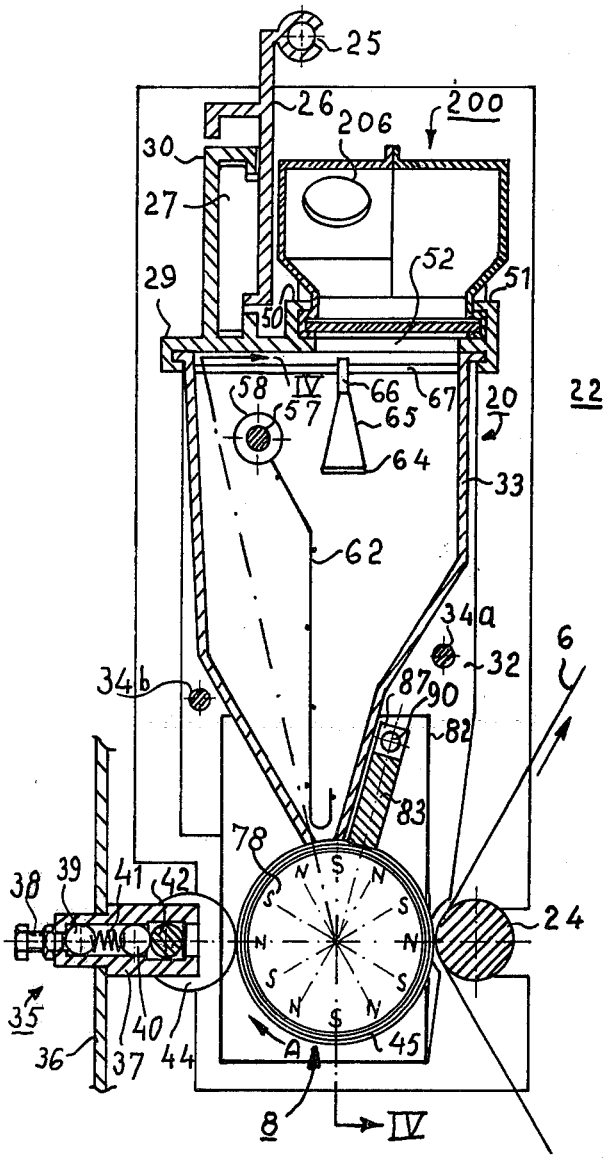
FIG. 3 is a cross section of the developing section of FIG. 2, taken along the line III—III in FIG. 4.

As shown in FIG. 3, the magnetic brush 8 comprises a number of stationary internal magnets 78 about which a driven cylinder 81 of non-magnetizable material, such as aluminium, is installed rotatably. Magnetizable developing powder is supplied to the magnetic brush 8 from a toner powder reservoir 20, which will now be described further with reference to FIGS. 2, 3, 4 and 5.

FIG. 2 shows a way of suspending the toner powder reservoir 20 with the magnetic brush in the copying apparatus. The copying apparatus is provided with frame plates 21 and 22, between and in which the rollers mentioned with regard to FIG. 1 are rotatably supported in bearings. The frame plate 21 is provided with an opening 23 (FIG. 2) of almost the same form and of slightly greater dimensions than the toner powder reservoir 20.

A rod 24 having a smooth outer surface is fixed between the frame plates 21 and 22, over which rod the photoconductive belt 6 is conveyed. A rail 26 provided with a lateral guide 27 (FIG. 3) is fixed rotatably to a rod 25 fixed between the frame plates 21 and 22. An upper plate 29 of the toner powder reservoir 20 is provided with a rail 30 which fits onto and is slidable along the guide 27 for mounting the reservoir 20 in the copying apparatus.

The reservoir 20 comprises two frame plates 31 and 32 between which a chamber 33 to be described further is installed. These plates are connected with each other by tie rods 34*a* and 34*b*. The magnetic brush 8 is supported in bearings in the frame plates 31 and 32 in a way to be described below. In the position in which the reservoir 20 is shown in FIG. 2 and FIG. 3, the center of gravity of the reservoir 20 lies on a vertical line located to the right of the vertical line through the rod 25. Consequently, the reservoir 20 with the magnetic brush 8 tends to swivel away from the rod 24, owing to which the reservoir 20 with the magnetic brush 8 can easily be installed in the copying apparatus and be removed from it, respectively, without causing damage to the belt 6 where the belt passes over rod 24.

The reservoir 20 with the magnetic brush 8 can be moved toward the rod 24 with the aid of an eccentric mechanism 35. The eccentric mechanism 35 comprises a support plate 36 fixed between the frame plates 21 and 22 and a tubular element 37 fixed in the plate 36 near each frame plate. One end of each element 37 is screw-threaded so that a screw 38 can be turned into the cavity of the element 37. A first part of this cavity houses a pair of balls 39 and 40 which are pressed away from each other by an intervening spring 41. A shaft 42 extends through a second part of the cavity and is rotatably supported in bearings in the element 37, and an end of the shaft 42 extends outside the frame plate 21 where it is provided with a lever 43 (FIG. 2) by which the shaft 42 can be turned. An eccentric 44 is firmly mounted on the shaft 42 near each element 37, and each eccentric 44 is located opposite to a ring 45 or 46, respectively. Each of the rings 45 and 46 is divided in axial direction into parts that may have different diameters; and the eccentrics 44 are located opposite to the first ring parts 47 and 48, respectively. The rings 45 and 46 are fixed to the frame plates 31 and 32 by bolts 49*a* through 49*f*.

The reservoir 20 is mounted in the copying apparatus as follows:

With the aid of the lever 43 the shaft 42 and the eccentrics 44 are rotated over an angle of 180° starting from the position shown in FIGS. 2 and 3. This retracts the eccentrics so that the reservoir 20 can be slid freely over the guide 27 into the copying apparatus, without obstruction by either the eccentrics 44 or the rod 24. When the reservoir has been slid sufficiently far into the copying apparatus, such as for instance with the guide 30 up to a stop (not shown) on the guide 26, the eccentrics 44 are turned back into the position shown in FIGS. 2 and 3. Thus the eccentrics 44, acting via parts 47 and 48 of the rings 45 and 46, respectively, push the reservoir 20 toward the rod 24 until the ring parts 47 and 48 abut against the rod 24 as shown in FIG. 3.

The construction of the reservoir 20 and of the magnetic brush 8 will now further be explained with reference to FIGS. 3 and 4. The upper plate 29 of the reservoir 20 is provided not only with the guide 30 but also with two guides 50 and 51, which run parallel to the guide 30. A holder 200 for toner powder can be moved in the guides 50 and 51, as will be described further in connection with FIGS. 6 through 10. Between the guides 50 and 51 the upper plate 29 is provided with an oblong filling opening 52, through which toner powder can stream from the holder 200 into the chamber 33. The chamber 33 on the one hand is joined with the upper plate 29 in a powdertight way, and on the other hand it leads into a gap of about 2 mm wide located at the magnetic brush 8. Near the upper plate 29 two shaft bushings 55 and 56, respectively, are mounted in the side walls 53 and 54 of chamber 33, and a shaft 57 is movable in its longitudinal direction in these bushings. The copying apparatus is provided with means not shown, such as an eccentric on a vertical shaft, for driving the shaft 57 forth and back. The shaft 57, however, is always biased to a certain normal, or standard, position, as by means of bushings 58 and 59 mounted firmly on the shaft 57 and spiral springs 60 and 61, respectively, which are compressed between the bushings 55 and 58 and the bushings 59 and 56, respectively. Between the bushings 58 and 59 a grid 62 is firmly fixed to the shaft 57 so that it can be moved forth and back with the shaft 57. The grid moving forth and back prevents the toner powder in the chamber 33 from coagulating or forming lumps by becoming more compact. During the operation of the copying apparatus the shaft 57 can be moved forth and back continuously. Depending upon the properties of the toner powder, it may also be sufficient for instance to move the shaft 57 forth and back once after each production of a certain number of copies.

A mechanism 63 cooperating with the shaft 57 is provided (see FIG. 4) for indicating whether toner powder is present at a sufficient level in the chamber 33. The mechanism 63 comprises a flat powder feeling plate 64, fixed to the end of an arm 65 which via an arm 66 is rotatable about a shaft 67. Opposite to the arm 66 an element 69 having a squarely angled leg is fixed slidably in a bushing 68 on the frame plate 32. The shaft 57 has a plate 70 fixed thereon, which at a location opposite the angled leg of element 69 is provided with a screw hole in which a set screw 71 is threaded. A switch 73 is fixed to the frame plate 32 by a corner support 72. The switch 73 has an arm 74 the end of which is situated opposite the end 75 of the angled leg of element 69 but is at a certain distance from this leg in the normal position of the shaft 57.

Figure 4:
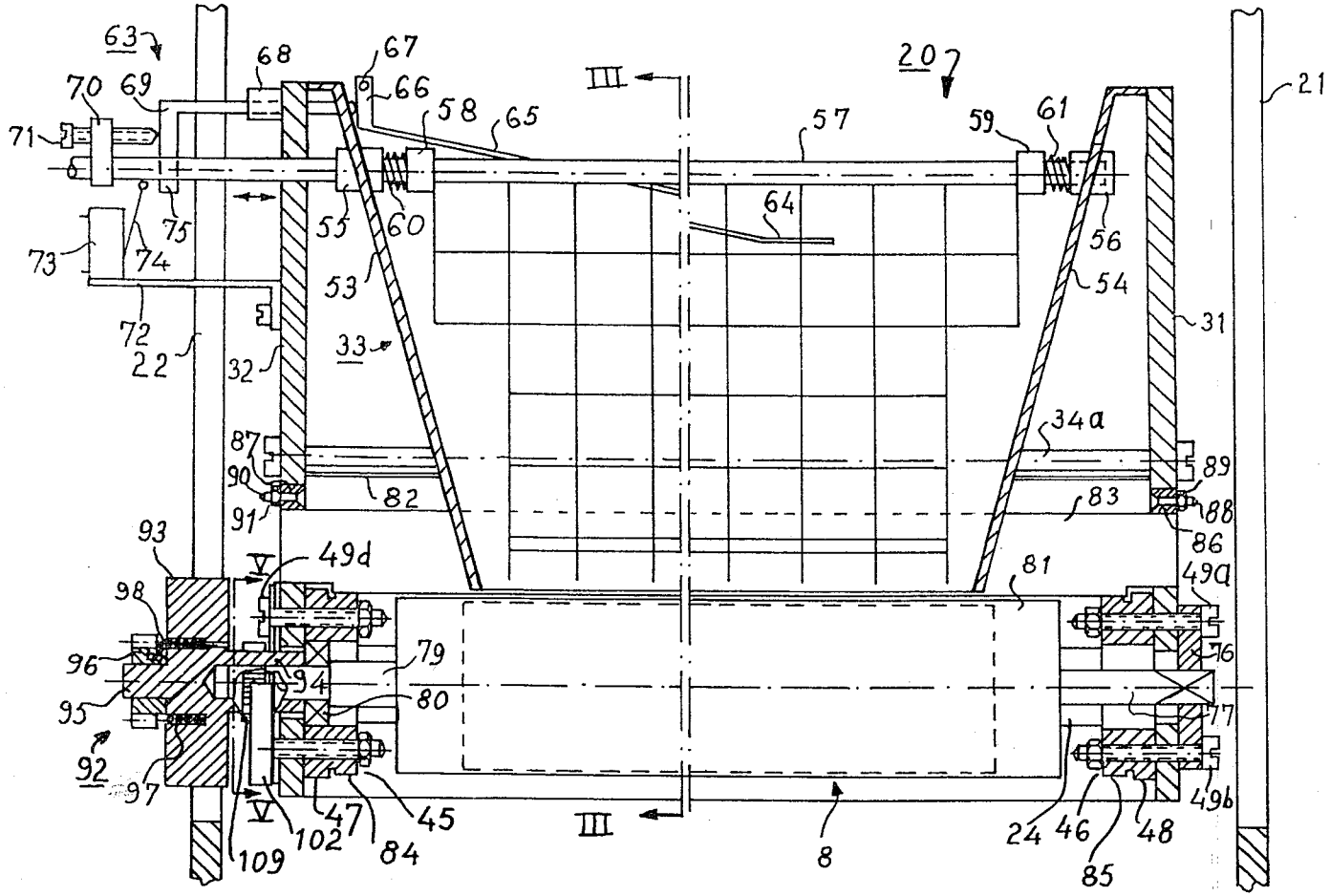
FIG. 4 is a section taken along the line IV—IV in FIG. 3.

The operation of the mechanism 63 is as follows:

When the shaft 57 is in its normal position as shown in FIG. 4, the set screw 71 is turned into the plate 70 until the arm 65 is in a position as shown in FIG. 4. The mechanism for moving the shaft 57 is arranged so that the forward movement of shaft 57 is to the left in FIG. 4 and the backward movement is to the right up to the normal position shown in FIG. 4. During the forward movement the screw 71 moves with the shaft 57 to the left in FIG. 4, thus freeing the element 69 so that it can be moved to the left by a clockwise movement of the arms 65 and 66, which movement will occur as long as the arm 65 can be moved downward by its own weight. Downward movement of arm 65 continues until the powder feeling plate 64 reaches a position of rest on the toner powder present in the chamber 33. Depending upon the level up to which the powder is present, the arm 65 moves downward farther or less far, and consequently the element 69 moves to the left farther or less far. When the arm 65 moves downward to a certain location, because of the level of toner powder in the chamber 33 having decreased below a desired minimum value, the arm 74 of the switch 73 is operated by the end 75 of the angled leg of element 69.

This switch operation can be used for activating a signalling device on the copying apparatus, thus indicating that the level of the toner powder in the chamber 33 is too low and that an addition of toner powder is needed.

The magnetic brush 8 and the pertaining drive are assembled as follows: The rings 45 and 46, which are fixed on the frame plates 32 and 31, respectively, by the bolts **49*a* through 49*f*, are each provided with a central opening aligned with an opening in the adjacent frame plate 32 or 31. A plate 76 also is fixed to the outer side of frame plate 31 by the bolts 49*a*, 49*b* and 49*c*, and plate 76 is provided with a square opening in which a square end of a shaft 77 is fitted. Fixed on the shaft 77 is a suitably large number of axially disposed bar magnets 78**, for instance twelve (12) of them, the poles (N,S) of which extend in axial direction. These magnets are so arranged that their north and south poles alternate in the circumferential direction.

The end of shaft 77 toward the left in FIG. 4 is supported in bearings in a rotatable stub shaft 79 which extends through a bearing 80 supported in the ring 45. A cylinder 81 of non-magnetizable material, such as aluminum, is firmly connected with the stub shaft 79 and, at the right end in FIG. 4, is rotatably supported by a bearing on the shaft 77. Thus, the cylinder 81 can be rotated about the magnets 78 by driving the stub shaft 79, while the magnets 78 are held stationary with the shaft 77.

By rotating the cylinder 81 in the direction of the arrow A (FIG. 3), magnetizable toner powder from the supply in the chamber 33 is formed into a layer of toner powder on the outer surface of the cylinder 81. A layer of toner powder is kept attracted to the surface of the cylinder 81 by the magnetic field of magnets 78, so that it does not fall down from the cylinder 81. During the development of an electrostatic charge image on the belt 6, the cylinder 81 rotates and the toner particles held on it are subjected to a centrifugal force. This force together with friction between the toner particles and the air around the magnetic brush 8 may be great enough to remove some toner particles from outer regions of the layer of toner particles formed on the cylinder 81. This would be a source of contamination of the interior of the copying apparatus by toner particles. In order to avoid such contamination, an enclosure 82 is provided which extends between the frame plates 31 and 32 and around the magnetic brush 8. The enclosure 82 is provided with end wall openings which accommodate the eccentrics 44, and with a side wall opening in which a portion of the cylinder 81 runs at the location of the rod 24.

A scraper 83 for limiting the amount of toner powder on the cylinder 81 is mounted between the frame plates 31 and 32 and extends parallel to the shaft 77 in a position fixed so that the scraper 83 extends radially in relation to the axis of the cylinder 81 and shaft 77. It is of great importance that a gap be maintained between the scraper 83 and the cylinder 81, which is of constant width over the length of the gap. As a result of the rotation of the cylinder 81, toner powder is continuously supplied in the direction toward the scraper. The pressure of this powder tends to bulge the scraper near the center of its length, toward the right as viewed in FIG. 3, thus tending to make the gap width near the center of the cylinder 81 become greater than near the ends. Such overbulging, however, can be prevented by a combination of two measures, the first measure comprising the mounting of the scraper in radial relation to the axis of the cylinder, and the second measure being that the dimension of the scraper 83 in the direction tangential to the cylinder 81 is made at least as great as the extent of any bulge that could result from toner powder being pressed against the scraper.

A precise adjustment of the scraper gap to the desired width is obtained as follows: The rings 45 and 46 are each provided with a second ring part 84 or 85, respectively, on each of which an edge of the scraper rests as shown in FIG. 3 and FIG. 4. The diameter of these ring parts is selected so that the gap has exactly the desired width when the scraper rests on them. Near the top of the scraper 83, pressure elements 86 and 87 of elastic material are mounted in the openings provided in the frame plates 31 and 32. The pressure elements 86 and 87 are each provided with a bolt 88 or 90, respectively, which extends lengthwise through the pressure element and has a nut 89 and 91, respectively, screwed onto it at the outer side of the related frame plate. By tightening the nuts on the bolts 88 and 90, the elastic pressure elements 86 and 87 are put under compression and bulged so that they press the scraper 83 in the direction toward the cylinder 81 and butt the scraper edge firmly against the ring parts 84 and 85. Dimensional deviations in the outer diameter of the cylinder 81 and, as well, in the diameter of the parts 84 and 85 can be kept very small by finishing these elements on a lathe, so that during assembly of the copying apparatus the exact gap width required is obtained by simply mounting the various parts as mentioned.

Figure 5:
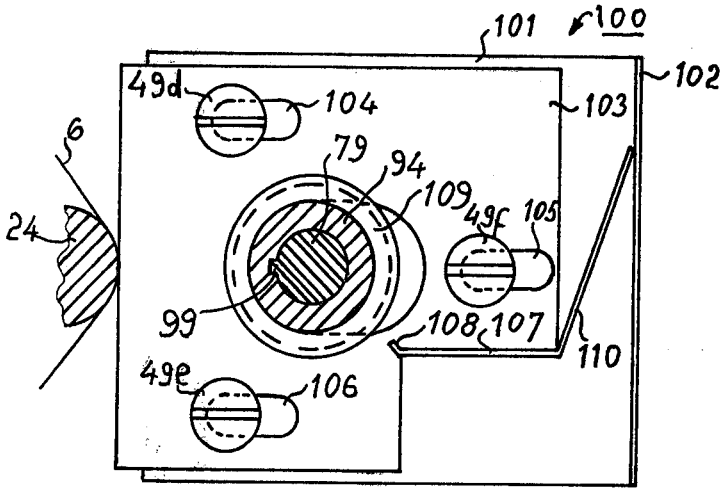
FIG. 5 is a section taken along the line V—V in FIG. 4.

For obtaining a good copy it is very important that the speed of rotation of the magnetic brush 8 be kept constant. The magnet brush 8 is driven via the stub shaft 79 and a coupling 92 by a motor (not shown), in such manner that the speed of rotation will not be altered by the switching on or off of other parts of the copying apparatus which are driven by the same motor. To this end, the coupling 92 comprises a flywheel 93 which at its inner side is provided with a hollow stub shaft 94 in which the stub shaft 79 is fixed firmly by a key 99 (FIG. 5). At its outer side the flywheel 93 is provided with a stub shaft 95 on which a gear 96 is mounted rotatably, which gear is driven directly or indirectly by the motor. The flywheel 93 is also formed with a cylindrical groove 97 in which a coiled spring 98 fits with some play. The flywheel 93 and the gear 96 are each provided with an opening in which and end of the coiled spring fits, so that the spring ends are firmly connected with the flywheel 93 and the gear 96, respectively. Thus, the motor acting on the gear 96 drives the magnetic brush 8 indirectly via the spring 98 and the flywheel 93. Vibrations or shocks occurring in the drive to the gear 96 are absorbed by the coiled spring and the flywheel so that the magnetic brush 8 is rotated at a constant speed.

A mechanism 100 shown in FIG. 5 serves to prevent rotation of the magnetic roll 8 when the powder reservoir 20 with the magnetic roll 8 is being removed from the copying apparatus. The mechanism 100 comprises a plate 101 having an angled edged 102. The plate 101 is fixed immovably on the frame plate 32 by screws 49*d*, 49*e* and 49*f*, and a plate 103 overlies plate 101 and is formed with slots 104, 105 and 106 so that the plate 103 is movable forth and back over the plate 101. The plate 103 is formed with a flange 107 having an upturned end 108 that can be engaged with teeth of a gear 109 which is fixed firmly on the stub shaft 94. A backward, angled end portion of the flange 107 forms a blade spring which bears against the edge 102 and thus tries to move the plate 103 towards the left, out of the position shown in FIG. 5, and to keep it there.

The operation of the mechanism 100 is as follows: When the reservoir 20 is installed in the copying apparatus and the rings 45 and 46 are pressed against the rod 24 by a turn of the lever 43, the plate 103 bears against the rod 24 as shown in FIG. 5 and the blade spring 110 is tensioned. The end 108 is then disposed away from the gear 109, so that the cylinder 81 can be driven freely. Upon a reverse half rotation of the lever 43, the magnetic roll 8 swivels away from the rod 24 as previously described, thus causing the shaft 79 with the stub shaft 94 and gear 109 to move toward the right as seen in FIG. 5. However, due to the force of the tensioned blade spring 110 and the presence of the slots 104, 105 and 106, the plate 103 remains pressed against the rod 24 until the flange end 108 is engaged with teeth of the gear 109. Then, as the magnetic roll 8 swivels farther away from the rod 24, the plate 103 also comes free from rod 24 and the gear 96 becomes disengaged from a driving gear (not shown) which is driven directly or indirectly by the previously mentioned motor.

Figure 6:
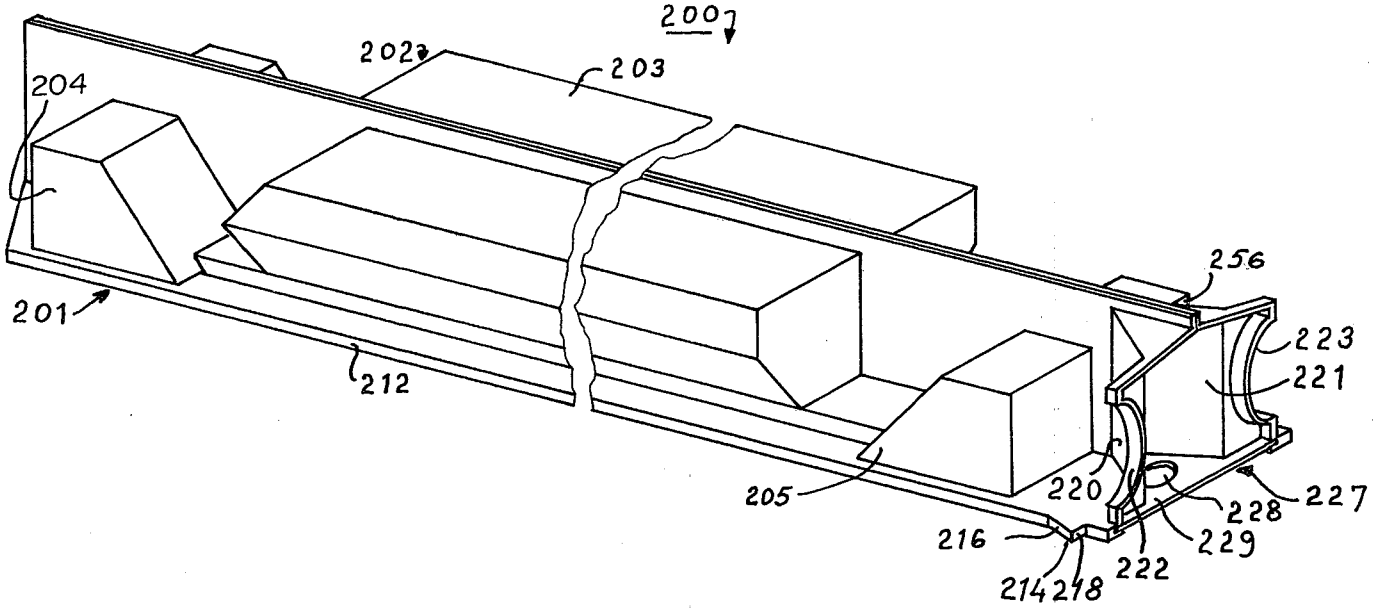
FIG. 6 is a perspective view of the holder for electrographic toner powder in operative position.
Figure 7:
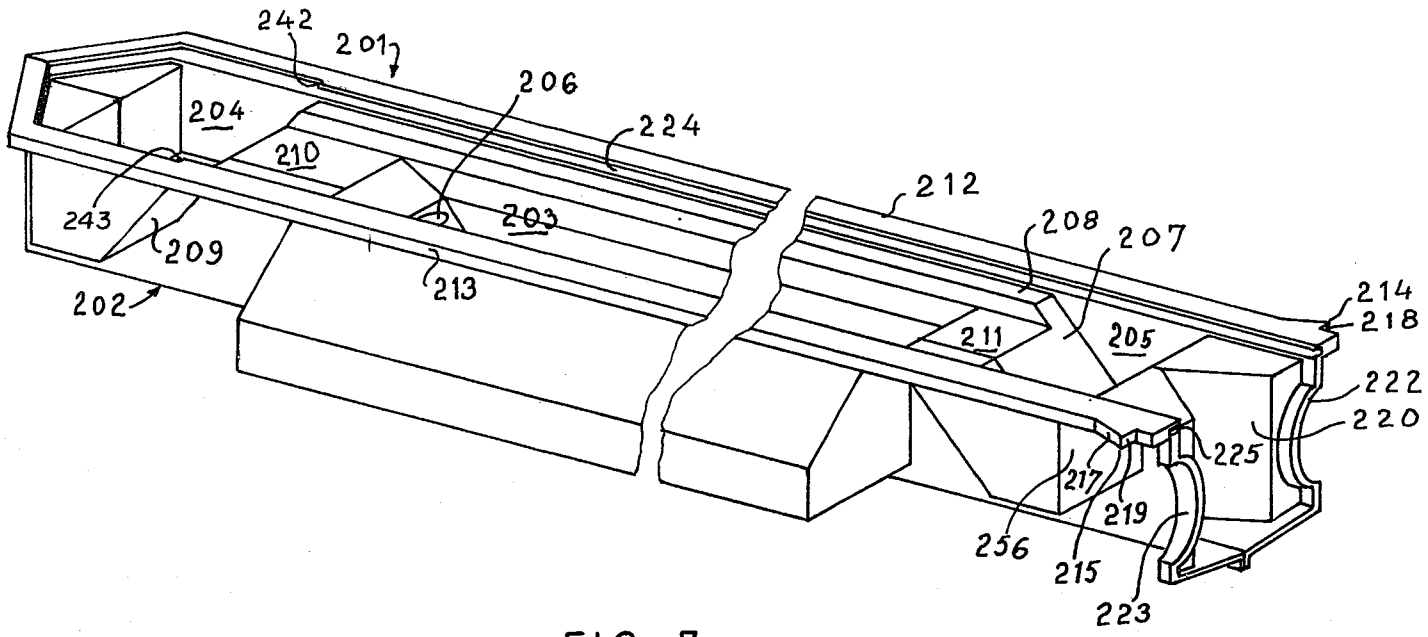
FIG. 7 is a perspective view of the lower side of the holder of FIG. 6, without showing the slide valve and the membrane.

FIG. 6 and FIG. 7 show in perspective an upper view and a lower view, respectively, of a holder 200 for toner powder, which holder is especially suitable for adding powder to the powder reservoir 20. The holder 200 comprises two halves 201 and 202, preferably composed of injection-molded or deep drawn plastic, each of which is substantially a mirror image of the other. The two halves are joined together, for instance by adhering them with a suitable glue, so that they constitute a unitary whole in construction and operation for the purposes of the present invention.

The holder 200 comprises a first chamber 203 for receiving a quantity of toner powder, as well as a second chamber 204 and a third chamber 205, respectively, for receiving a cutting device to be described below. The chamber 203 is provided with an opening 206 which can be closed and through which this chamber can be filled with toner powder. The chamber 203 is closed off over the lower side shown in FIG. 7 by a membrane (not shown). The membrane is fixed powder-tight on the holder 200, for instance, by being glued to it along a line which runs from the end surface 207 of the chamber 205 over a surface 208 extending longitudinally of the holder 200, then over the end surface 209 of chamber 204 and the equivalent end surface of the half 202 (which latter surface is not visible in FIGS. 6 and 7), and then back along a surface corresponding to surface 208 to an end surface 207 of the half 202. Recessed surfaces 210 and 211 of the holder are located between the three chambers and are spaced from the plane of surface 208 so that there is a certain distance between the membrane and the surface 210 and 211.

The holder 200 is provided longitudinally with oppositely protruding side flanges 212 and 213 which fit into, and on which the holder 200 is movable in and along, the guides 50 and 51 on the upperplate 29 of the reservoir 20. Near one end of the holder 200 the flanges 212 and 213 are provided with projecting portions 214 and 215, respectively, each of which comprises an outwardly sloped surface 216 or 217, respectively, which lies at an acute angle to the longitudinal axis of the holder 200, and a straight end surface 218 or 219, respectively, which lies at a right angle to that longitudinal axis. At the same end of the holder there are extended side wall portions 220 and 221 which normally diverge from each other but are elastically convergible by pressure. Thus, the distance between the projections 214 and 215 can be reduced by exerting pressure on the wall portions 220 and 221. Such pressure can be exerted, for instance, by grasping said one end of the holder with one's fingers at finger grips 222 and 223 and pinching the finger grips 222 and 223 towards each other.

Figure 9:
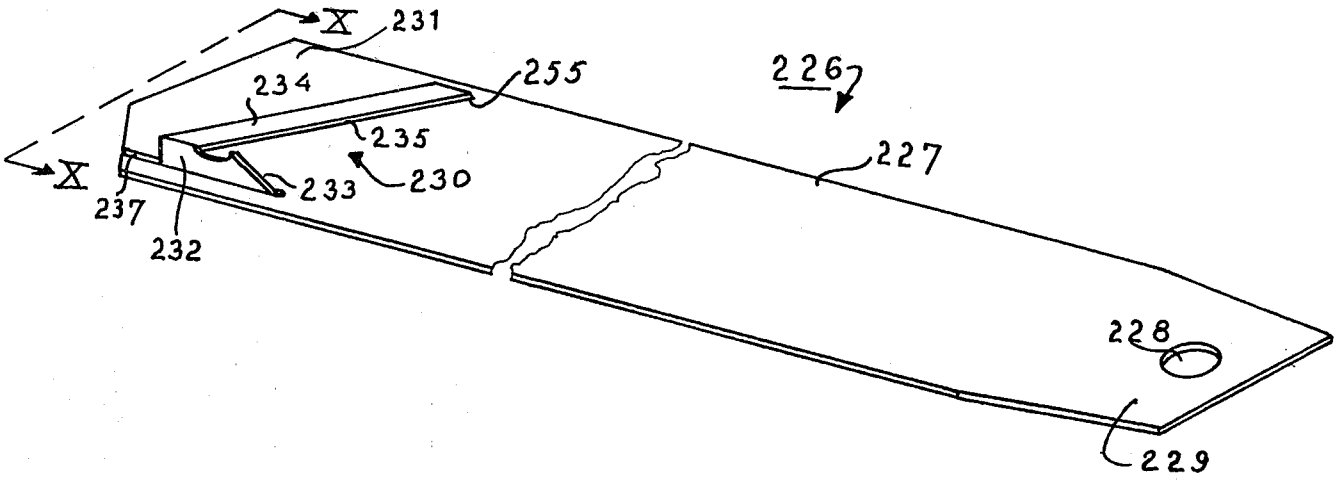
FIG. 9 is a perspective view of the slide valve with the cutting device thereon.

The flanges 212 and 213 are provided along their inner edges with confronting longitudinal channels 224 and 225, respectively. The channels 224 and 225 are made to receive edge portions of a slide valve 226 (FIG. 9). The slide valve is formed with a narrowed end 229 provided with a finger opening 228, and a knife 230 is mounted on its other end 231. FIG. 9 shows the slide valve 226 oriented as it is positioned when assembled in the holder 200 of FIG. 6, in which condition the knife 230 is situated in the space of chamber 204.

The knife 230, as shown in FIG. 9, comprises a raised portion 232 having an oblique cutting edge 233 and a sloped portion 234, having a cutting edge 235, which lies parallel to the plane of the valve plate 227 and extends slightly obliquely forward toward the end 229 from the portion 232, to which the slope blade 234 is joined.

Figure 10:
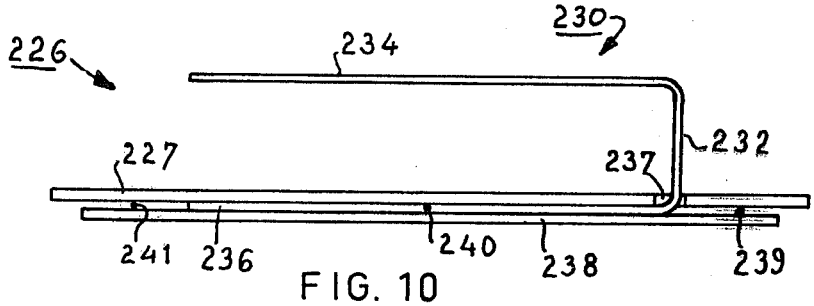
FIG. 10 is a view of the slide valve taken along the line X—X in FIG. 9.

The knife 230 further comprises a flat foot portion 236 at the lower side of the plate 227, as shown in FIG. 10, which foot portion extends from the raised portion 232 through a slot 237 in the plate 227 and holds the knife 230 in the position shown in FIG. 9. A plate 238 of plastic material is fixed over the foot portion 236, such as by spotwelds indicated at 239, 240 and 241 which join plate 238 to the plate 227, so that the knife is fixed firmly to the plate 227.

The slide valve 226 is assembled on the powder holder 200 by being slid into the channels 224 and 225 between the flanges 212 and 213. The channels have recessed wall portions at 242 and 243, which provide a widened area where the knife 230 is located when the slide valve 226 is in closed position.

Figure 8:
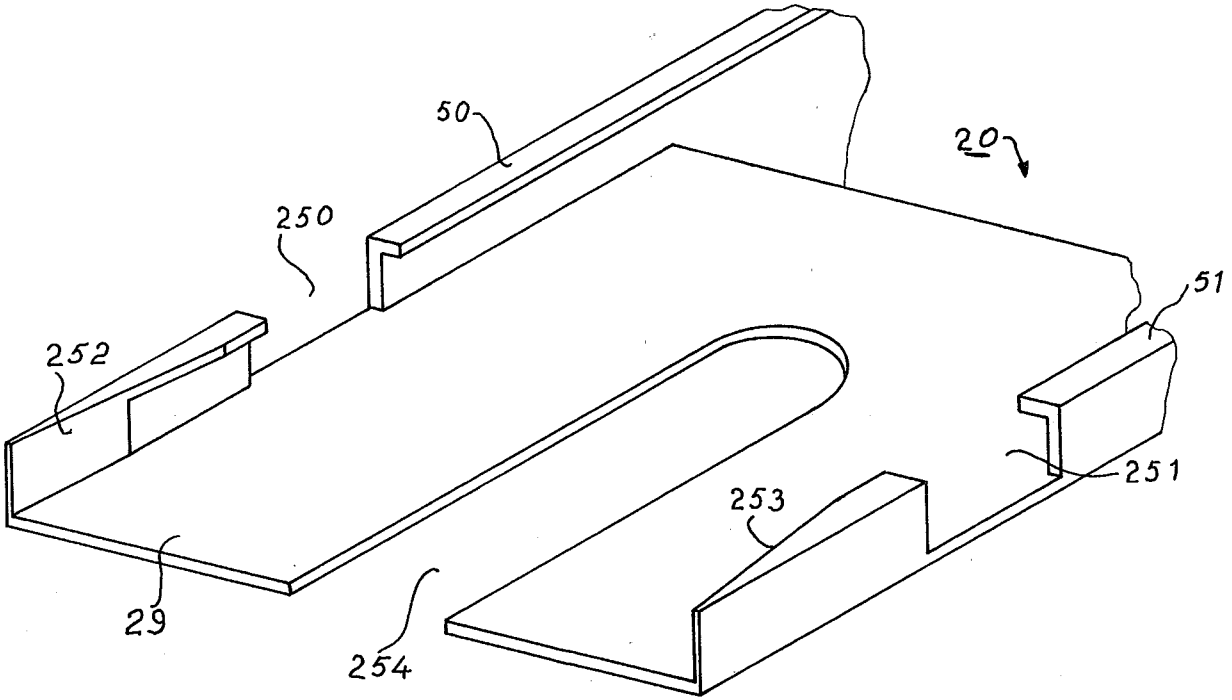
FIG. 8 is a perspective view of the end of the developing section, from which the holder of FIG. 6 is slid over the powder reservoir.

FIG. 8 shows particulars of a form of the guides 50 and 51 near their end at the side of the reservoir 20 from where the holder 200 is slid over the reservoir 20. Both of the guides 50 and 51 are interrupted near that side of the reservoir by openings 250 and 251, respectively, which receive the projecting portions 214 and 215 of the holder flanges. The guides 50 and 51 have at their end slightly bevelled edge portions 252 and 253, respectively, which facilitate installation of the holder 200. The upper plate 29 is provided with an opening 254 along its center between the guides 50 and 51, which serves to make the finger opening 228 in the slide valve easily accessible to a person attending the copying apparatus.

With the aid of the holder 200, toner powder can be supplied to the powder reservoir 20 as described below—for instance, after the mechanism 63 has given a signal indicating that the level of the toner powder in the reservoir 20 has become too low.

The holder 200, after having its chamber 203 filled with toner powder and closed off powder-tight by a membrane as described above, is slid into the guides 50 and 51 over the upper plate 29, starting with the end of the holder shown to the left in FIG. 6, to its working position above the powder reservoir 20. The material of the holder 200 being flexible, as the end 229 of the holder reaches the portion of the guides shown in FIG. 8 the projections 214 and 215 can easily pass along the sloped portions 252 and 253 of the guides 50 and 51, with a narrowing of the holder end 229. As soon as the projections 214 and 215 pass beyond the sloped portions 252 and 253 they are pressed into the opening, or notches, 250 and 251 by the elasticity of the material of the holder 200. The straight portions 218 and 219 of the projections 214 and 215, respectively, then lie against the backward side borders of the openings 250 and 251, respectively, and thus prevent the holder 200 from being slid inadvertently out of the guides 50 and 51. From this position, in which the powder-tight membrane on the holder is covered by the slide valve 226, the holder 200 can be slid out of the guides 50 and 51 only by pinching the finger grips 222 and 223 which, together with the flanges 212 and 213 at this location, form side wall portions at the end of the holder. Since the slide valve 226 is narrowed at the end 229, the projections 214 and 215 can be moved toward each other there by the pinching, thus reducing the distance between the projections to a span smaller than the distance between the guide portions 252 and 253 so that the pinched side wall portions of the holder 200 can then be slid out of the guides 50 and 51.

To empty the holder 200 after it has been slid over the reservoir 20 and latched in place by the projections 214 and 215 engaged in the openings 250 and 251, the slide valve 226 is simply pulled outward by one's fingers. Thus, as the end 231 of the slide valve 226 with the knife 230 thereon is moved along the holder, the knife 230 cuts the membrane in the following way: The pointed end 255 of the cutting edge 235 starts cutting the part of the membrane which leads from over the surface 210 to the surface 209. As the slide valve 226 is pulled further outward, the cutting edge 235 cuts the mentioned part to the membrane along a line parallel to the surface 210, up to a location near the surface 208. During the formation of this cut the cutting edge 233 has started forming a cut along the surface 208. As may be seen from the positions of the cutting edges 233 and 235 in FIG. 9, the two cuts join each other. Then, as the slide valve 226 is pulled farther outward, the cutting edge 233 forms a long cut in the membrane along the surface 208. In the course of this movement, the cutting edge 235 moves through the toner powder in chamber 203 and then reaches a location where the pointed end 255 starts forming a cut in the membrane, parallel to the surface 211, where the membrane extends from over the surface 211 to the surface 207. As will be evident, this cut also joins the cut being made by edge 233 along the surface 208. Further extraction of the slide valve 226 then is impeded by engagement of the knife 230 against an end wall 256 of the chamber 205.

By cutting the membrane open in the manner described, an important advantage is achieved in that the toner powder does not come into contact with the part of the slide valve 226 that is pulled out of the holder 200; so there is no risk of powder being drawn out for contamination of the operator's fingers or of environs of the apparatus. In addition, a second important advantage is obtained in that the portion of the membrane that is cut open by the knife 230 remains connected with the holder 200 along one side of the rectangular opening which results, through which opening the toner powder falls out of the holder 200 into the reservoir 20.

Furthermore, by virtue of the special construction of the slide valve 226 which is narrowed only at the end 229, the advantage is achieved that when the slide valve has been fully pulled outward the previously mentioned side wall portions at the holder end can no longer be converged by pinching them, because the available space between the channels 212 and 213 is fully occupied by the non-narrowed body of the slide valve 226. Since those side wall portions then can no longer be pinched toward each other, the projections 214 and 215 can no longer be moved towards each other; so the holder 200 then cannot be slid out of the guides 50 and 51. The emptied holder 200 can be slid out of the guides 50 and 51 only by first sliding the slide valve 226 back into a closed positon in which the narrowed portion 229 is located between the projections 214 and 215, in which position the parts of the holder 200 that have been in contact with toner powder are no longer accessible.

What is claimed is:

1. In a holder for electrographic developing powder, including a chamber for the powder having an oblong powder outlet opening closed powdertight by a membrane attached thereover, a slide valve movable between first and second positions respectively for closing off and uncovering said opening and means for positioning said holder above a developing powder reservoir of an electrographic apparatus for delivery of powder from the holder into the reservoir;

the improvement wherein said holder comprises guide means along said opening for guiding said slide valve between its said positions and said slide valve has cutting means mounted thereon near an end thereof, said cutting means being operative as said slide valve is moved from said first position to said second position to cut open along said opening a section of a membrane closing said opening.

2. A holder according to claim 1, further comprising stop means for preventing outward movement of said slide valve beyond said second position.

3. A holder according to claim 1 or 2, said cutting means being operative to cut said membrane along a cut line that in itself is not closed, so that the cut open membrane section stays attached to the holder.

4. A holder according to claim 3, said cutting means comprising a knife having a first cutting edge extending upwardly from said slide valve near a side edge thereof and having a second cutting edge extending over said slide valve at a distance therefrom not greater than the height of said first cutting edge.

5. A holder according to claim 1 or 2, comprising at a forward end thereof elastically flexible side wall portions and at least one lateral projection for latching the holder in delivery position over said reservoir, each said projection being substantially co-planar with said slide valve, said side wall portions being elastically contractible, by being pinched between one's fingers, so as to displace each said projection laterally inward.

6. A holder according to claim 5, said slide valve being narrowed in width near its forward end and being sufficiently wide near its end on which said cutting means is mounted to prevent laterally inward displacement of each said projection when the slide valve is in said second position.

7. A holder according to claim 1 or 2, comprising walls forming an elongate powder chamber open at its lower side and forming at the sides of said chamber longitudinal surfaces in a plane near said slide valve, at the ends of said chamber surfaces recessed away from said plane, and end surfaces which slope away from ends of the aforesaid surfaces and border forward and backward spaces for receiving said cutting means; the lower side of said chamber being coverable powdertight by a membrane adhered to said end surfaces and said longitudinal surfaces.

8. A holder according to claim 7, said cutting means comprising a knife having cutting edges movable along said chamber in the space between said slide valve and said recessed surfaces, said cutting edges including a first cutting edge extending upwardly from said valve near a side edge thereof and a second cutting edge extending obliquely over said slide valve in a plane between the respective planes of said longitudinal surfaces and said recessed surfaces.

9. A holder according to claim 5, said holer having longitudinal flanges thereon which fit and are slidable along parallel guides provided over said reservoir, said guide means being channels formed in and along inner sides of said flanges, each of said flanges having a said projection on an end portion of the flange adjacent to said contractible side wall portions.

10. In an apparatus for supplying powder for developing electrographic images, including a reservoir for holding a supply of the powder, a powder inlet opening at the top of said reservoir, a holder for powder to replenish the supply in the reservoir, said holder comprising a chamber for the powder having a powder outlet opening adapted to be closed powdertight by a membrane attached thereover and a slide valve movable between first and second positions respectively for closing off and uncovering said outlet opening, and means for positioning said holder over said reservoir for delivery of powder through said openings, the improvement which comprises interengageable elements respectively on said holder and said positioning means for latching said holder in powder delivery position; said holder comprising means operable by one's hand for disengaging said latching elements when said slide valve is in said first position; and means for preventing disengagement of said latching elements by said hand operable means when said slide valve is in said second position.

11. Apparatus according to claim 10, said positioning means comprising parallel guides extending over said reservoir; said holder having along its base flanges which fit and are slidable along said guides; said latching elements comprising a lateral projection on at least one of said flanges near an end thereof and for each said projection a mating notch in one of said guides; said hand operable means comprising side wall portions of said holder at an end thereof which, by being pinched between one's fingers, are elastically contractible so as to converge ends of said flanges and thus disengage each said projection from the related notch.

12. Apparatus according to claim 11, said flanges being formed with channels along their respective inner sides; said slide valve comprising a plate having substantially parallel longitudinal edge portions fitting slidably in said channels; said plate having a narrowed end portion which, when the slide valve is in said first position, is located opposite each said projection to enable disengagement of the latching elements by a pinching of said side wall portions; said plate being sufficiently wide backward of said narrowed portion to prevent such disengagement when the slide valve is in said second position.

13. Apparatus according to claim 10, 11, or 12, and further comprising cutting means operative as said slide valve is moved from said first position to said second position to cut open a section of a membrane closing said outlet opening.

14. Apparatus according to claim 13, said cutting means comprising a knife mounted on a backward end portion of said slide valve.

15. Apparatus according to claim 10, 11, or 12, said holder comprising walls forming an elongate powder chamber open at its lower side, and forming at the sides of said chamber longitudinal surfaces in a plane near said slide valve, at the ends of said chamber surfaces recessed away from said plane, and end surfaces which slope away from ends of the aforesaid surface and border forward and backward spaces for receiving said knife; the lower side of said chamber being coverable powdertight by a membrane adhered to said end surfaces and said longitudinal surfaces; said knife having cutting edges movable along said chamber in the space between said slide valve and said recessed surfaces.

16. Apparatus according to claim 15, said cutting edges including a first cutting edge extending upwardly from said slide valve near a side edge thereof and a second cutting edge extending obliquely over said slide valve in a plane between the respective planes of said longitudinal surfaces and said recessed surfaces.

* * * * *